United States Patent [19]

Shimada et al.

[11] Patent Number: 4,615,384

[45] Date of Patent: Oct. 7, 1986

[54] HEAT EXCHANGER FIN WITH LOUVERS

[75] Inventors: Yukio Shimada, Ebina; Noriaki Sonoda, Sagamihara, both of Japan

[73] Assignee: Nihon Radiator Co., Ltd., Tokyo, Japan

[21] Appl. No.: 624,117

[22] Filed: Jun. 25, 1984

[30] Foreign Application Priority Data

Jun. 30, 1983 [JP] Japan ..... 58-101372[U]

[51] Int. Cl.[4] ..... F28D 1/02

[52] U.S. Cl. ..... 165/152; 165/181

[58] Field of Search ..... 165/151, 152, 153, 173, 165/166, 181

[56] References Cited

U.S. PATENT DOCUMENTS

| | | | |
|---|---|---|---|
| 1,998,663 | 4/1935 | Emmons et al. | 165/153 |
| 2,008,566 | 7/1935 | Shapiro | 165/153 |
| 2,011,853 | 8/1935 | Emmons | 165/153 |
| 2,133,502 | 10/1938 | Emmons | 165/153 |
| 2,703,226 | 3/1955 | Simpelaar | 165/179 X |
| 3,003,749 | 10/1961 | Morse | 165/152 |
| 3,135,320 | 6/1964 | Forgö | 165/151 |
| 3,265,127 | 8/1966 | Nickol et al. | 165/152 |
| 3,635,283 | 1/1972 | Satchwell | 165/152 X |
| 3,916,989 | 11/1975 | Harada et al. | 165/151 |
| 4,311,193 | 1/1982 | Verhaegle | 165/153 X |
| 4,332,293 | 6/1982 | Hiramatsu | 165/153 |
| 4,469,167 | 9/1984 | Itoh et al. | 165/152 X |
| 4,469,168 | 9/1984 | Itoh et al. | 165/152 |

FOREIGN PATENT DOCUMENTS

| | | | |
|---|---|---|---|
| 594344 | 3/1960 | Canada | 165/166 |
| 1018691 | 1/1953 | France | 165/166 |
| 0107896 | 8/1980 | Japan | 165/173 |
| 0082690 | 5/1982 | Japan | 165/151 |
| 867598 | 5/1961 | United Kingdom | 165/146 |

*Primary Examiner*—Albert W. Davis, Jr.
*Assistant Examiner*—Randolph A. Smith
*Attorney, Agent, or Firm*—Gordon W. Hueschen

[57] ABSTRACT

A heat exchanger comprising a tube for guiding heat-exchange fluid and a fin affixed to the outer side of said tube and adapted to guide air for exchanging heat with said heat-exchange fluid, said fin having an opening formed in the web thereof and a multiplicity of louvers formed astraddle said opening substantially perpendicularly to the direction of the flow of said air as staggered across said opening, said louvers each comprising a louver body separated by a fixed distance from said web of said fin and two legs connecting the opposite ends of said louver body to said web of said fin.

6 Claims, 10 Drawing Figures

HEAT EXCHANGER FIN WITH LOUVERS

BACKGROUND OF THE INVENTION

1. Field of the Invention

This invention relates to a heat exchanger. More particularly, this invention relates to a heat exchanger useful as an evaporator or a condenser mainly in an automobile air conditioner.

2. Description of Prior Art

The heat exchangers (evaporators) in the automobile air conditioners are mostly of the fin-and-tube type formed by combining round tubes and plate fins, the laminated type formed by laminating a plurality of tray-shaped plates thereby giving birth to tubes for the passage of coolant and nipping corrugated fins in the gaps between the adjacent tubes, or the profile tube type formed by extrusion molding a tube containing a multiplicity of through holes for passing coolant, zigzagging the tube and nipping corrugated fins between the adjacent folds of the zigzagged tube.

FIG. 1 is a cross sectional view illustrating a typical evaporator of the laminated type. This evaporator 1 is formed by laminating a multiplicity of tube units 5 each composed of a pair of tray-shaped plates (pieces) 2 joined to each other by the flanges 3 thereof after the fashion of the joined shell of a cream puff to enclose therewith a passage 4 for coolant and nipping corrugated fins 7 in the intervening spaces 6 between the adjacent tube units 5. The coolant which flows in via a conduit 8 on the inlet side, passes through the interiors of the tube 5, and flows out via a conduit 9 on the outlet side, therefore, exchanges heat with the air which flows along the fins 7.

A typical evaporator of the profile tube type has an appearance as shown in FIG. 2. This evaporator 11 is formed by zigzagging a flat tube 14 containing a multiplicity of through holes 13 for passing coolant and nipping corrugated fins 15 in the intervening spaces between the folds of the zigzagged tube 14. The coolant which flows in via a conduit 16 on the outlet side, passes through the interior of the tube 15, and flows out via a conduit 17 on the outlet side, therefore, exchanges heat with the air which flows along the fins 15.

FIG. 3 is a perspective view illustrating part of the evaporator of FIG. 2 in an enlarged state. In the corrugated fins 15, louvers 18 are formed as illustrated in FIG. 3. In the fins used in evaporators of other types, similar louvers are formed. The reason for the formation of the louvers 18 in the fins 15 in the manner described above is that the louvers 18 impart an edging effect to the fins 15 and, consequently, enhances the fins' overall heat-transfer efficiency without changing the total surface area of the fins and the louvers put together.

For any evaporator, the improvement of the efficiency of heat transfer between the coolant and the air constitutes an important question. Besides, the evaporator by nature collects water condensate on its surface from the moisture in the air. This condensate is desired to be removed from the evaporator as soon as possible without being scattered backwardly of the evaporator. The selection of a measure for this removal of the condensate, therefore, constitutes another important question.

The measure heretofore adopted for preventing the condensate formed on the evaporator from being scattered backwardly of the evaporator has consisted in disposing a metallic net behind the evaporator. The water condensate adhering to the fins of the evaporator, for example, may be blown backwardly of the evaporator when it is exposed to the air flowing along the fins and then backwardly of the evaporator. To preclude this mishap, the water condensate on the fins is desired to fall down inside the evaporator if circumstances permit.

From such a point of view, attention has been directed to the louvers formed in the fins and efforts have been made to utilize these louvers not merely for enhacing the efficiency of heat transfer but also for facilitating the dischage of water condensate.

To be more specific, when the air flowing along the fins incorporating these louvers comes into contact with the fins, there ensues deposition of water condensate on the fins. This water condensate has the possibility of being swept over the fins and then scattered backwardly of the fins by the current of air. To precluude this danger, the louvers have been adapted to guide the water and let it fall naturally under gravitation. To harness the gravitation for the purpose of enabling the water condensate to fall quickly without fail, the angle of inclination $\theta$ illustrated in FIG. 4 is desired to be increased as much as possible. Unfortunately, this angle cannot be increased amply because an increase of this angle $\theta$ could result in separation of the boundary layer formed on the surface of the louvers. The proposition that the desirable value of $\theta$ generally falls in the neighborhood of 15 degree has found recognition.

Various experiments have been conducted in search for the most desirable value of this angle of inclination $\theta$ of the louvers for the purpose of enabling the water condensate deposited on the fins to fall smoothly toward the lower part of the evaporator without the slightest sacrifice of the high efficiency of heat transfer. Consequently, the following knowledge has been acquired.

In the evaporator incorporating such conventional louvers as illustrated in FIG. 4, the main current F of air flowing between fins adjacent to each other in the vertical direction and the branched current f of air flowing between louvers adjacent to each other in the direction of the main current F have different flow speed; the flow speed of the branched current f is very small as compared with that of the main current F. Moreover, when the water condensate W adhering to the upper side of one louver is left growing in volume, it will bulge and eventually reach the lower side of the water condensate w similarly adhering to the immediately next louver to close the path for the branched current. It is possible that, depending on the relative location of the pair of louvers under discussion, the force with which the water condensate adheres to the louver under surface tension will surpass the sum of the force with which the water condensate is caused to fall under gravitation and the force exerted by the branch current. It is not inconceivable that when the water condensate grows to the extent of filling up the gap between the two adjacent louvers and consequently closes the path for the branched current f, the force with which the water condensate tends to remain in the gap will increase.

When the water condensate is left growing to the extent of closing the path for the branched current f, the surface tension of the water condensate will increase and, as the result, the water condensate subsequently collecting will be entrained by the passing air and carried backwardly of the evaporator instead of being caused to fall down under gravitation. This phenomenon may be precluded by increasing the intervals separating the louvers adjacent to each other in the direction of the main current of air. Unfortunately, such an addition to the intervals will result in a decrease in the number of louvers per unit length of the evaporator and in a sacrifice of the overall efficiency of heat transfer.

It is, therefore, an object of this invention to provide a novel heat exchanger.

Another object of this invention is to provide a heat exchanger so constructed that the heat transfer is improved to the highest possible extent where the intervals and length of the fins and the width and number of the louvers formed in the fins are fixed.

Yet another object of this invention is to provide a heat exchanger so constructed that when it is used as an evaporator, it will enable the water condensate adhering to the fins and their louvers to be quickly discharged.

SUMMARY OF THE INVENTION

The objects described above are accomplished by a heat exchanger which comprises a tube for guiding heatexchange fluid and a fin affixed to the outer side of the tube and adapted to guide air for exchanging heat with the aforementioned heat-exchange fluid, the fin having an opening formed in the web thereof and a multiplicity of louvers formed astraddle the opening substantially perpendicularly to the direction of the flow of the aforementioned air as staggered across the opening, the louvers each comprising a louver body separated by a fixed distance from the web of the fin and two legs connecting the opposite ends of the louver body to the web of the fin.

When the heat exchanger of this invention is used as a condenser or a heater core, it serves to improve the efficiency of heat transfer and, therefore, permits a reduction in size proportionately. When it is used as an evaporator, the force of the current of air flowing along the fins can be utilized fully as the force for discharge of the water condensate and it can also be utilized for retaining the largest possible area for the path of discharge of water between the adjacent louvers. By fixing the conditions of fins and their louvers similarly to those of the conventional countertypes, therefore, the heat exchanger as the evaporator improves the overall efficiency of heat transfer and, at the same time enables the water condensate formed on the evaporator to be quickly discharged. The water condensate is no longer allowed to be scattered from the trailing end of the evaporator.

PREFERRED EMBODIMENT OF THE INVENTION

Figure 5:
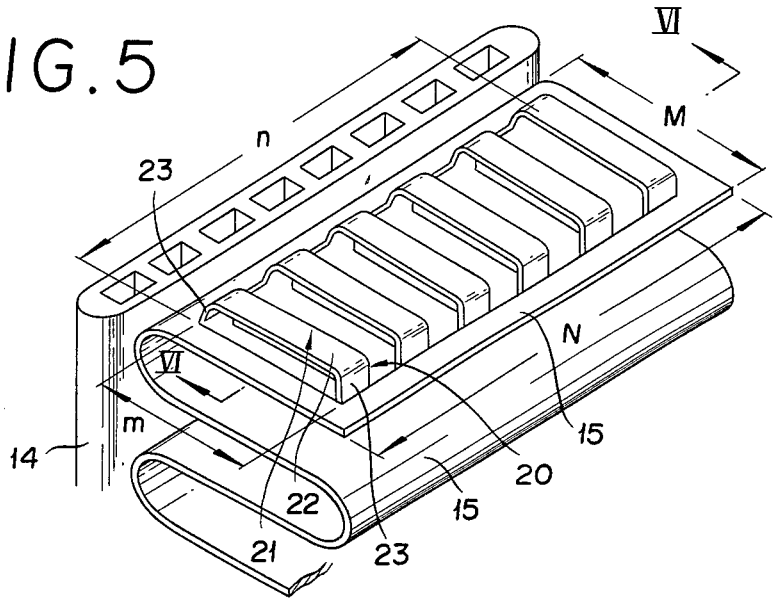
FIG. 5 is an enlarged perspective view of the essential part of a typical heat exchanger of this invention.
Figure 6:
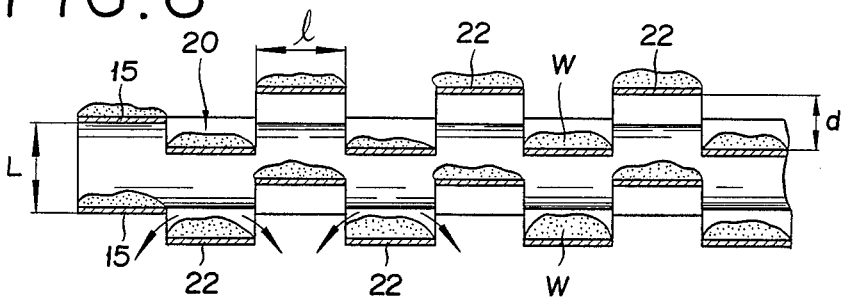
FIG. 6 is a schematic cross sectional view taken along the line VI—VI in the diagram of FIG. 5.

Now, this invention will be described below with reference to an evaporator illustrated as one embodiment of this invention. FIG. 5 depicts the evaporator of this invention as embodied in an evaporator of the profile tube type. Only part of a tube 14 and part of a fin 15 are illustrated. FIG. 6 is a diagram of a cross sectional view taken along the line IV—IV of the diagram of FIG. 5.

As shown in FIG. 5, the folds of the corrugated fin 15 each has a length N and width M. In each fold of the fin 15, a water outlet 20 of a length n and a width m is formed as an opening. The fold of the fin 15 has a multiplicity of louvers 21 formed astraddle the water outlet 20. Each of these louvers 21 comprises a louver body 22 separated by a fixed distance of d/2 from the surface of the fin and legs 23 connecting the opposite ends of the louver body 22 to the fin 15. The louvers 21 are staggered across the opening, i.e. arranged alternately on the upper side and the lower side of the fin 15, so that each pair of louvers adjacent to each other give rise to an empty space for water discharge. The size of this empty space is designated by d.

Figure 1:
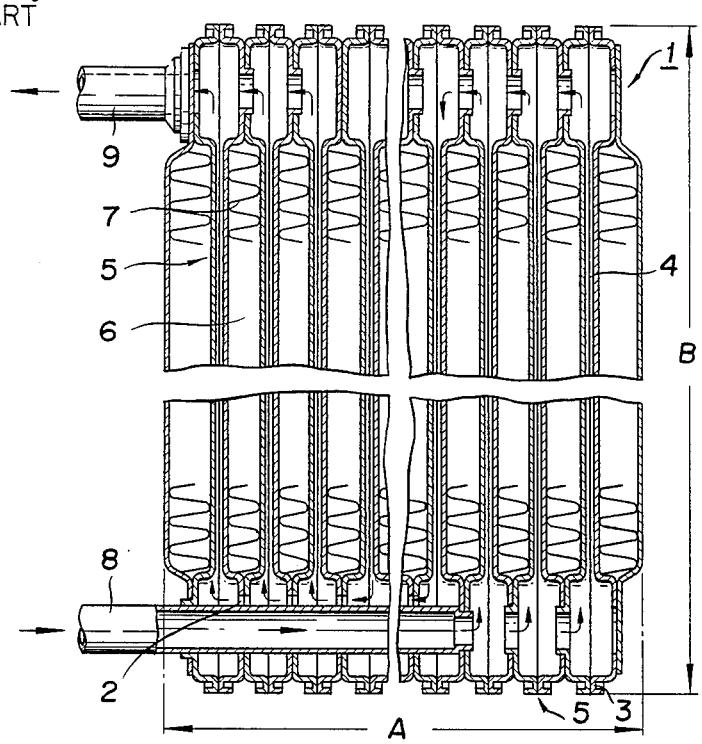
FIG. 1 PRIOR ART
FIG. 1 is a cross sectional view of a heat exchanger of the laminated type.
Figure 2:
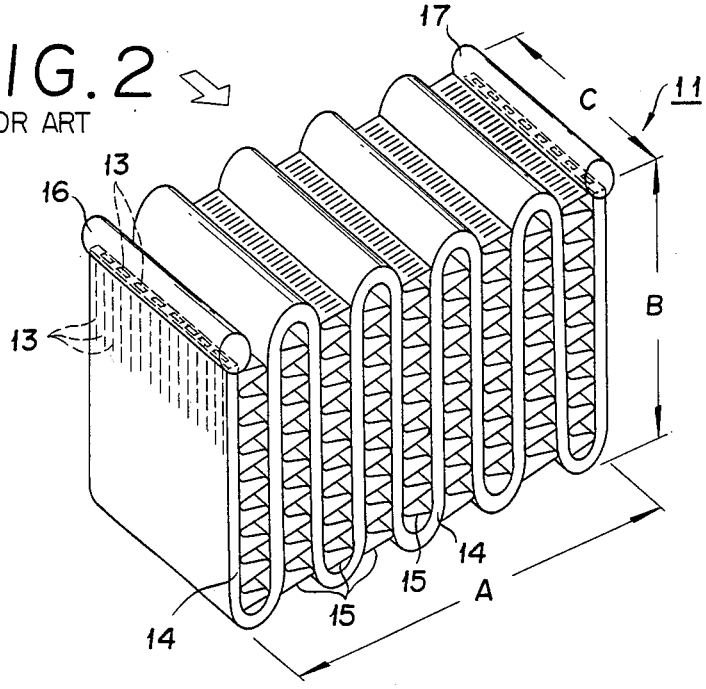
FIG. 2 PRIOR ART
FIG. 2 is a perspective view of a heat exchanger of the profile tube type.
Figure 3:
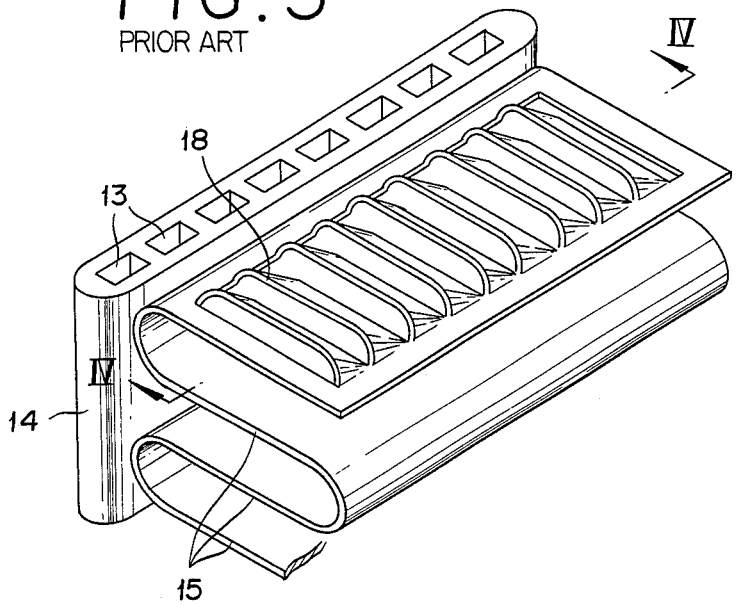
FIG. 3 PRIOR ART
FIG. 3 is an enlarged perspective view of the essential part of the heat exchanger of FIG. 2.
Figure 7:
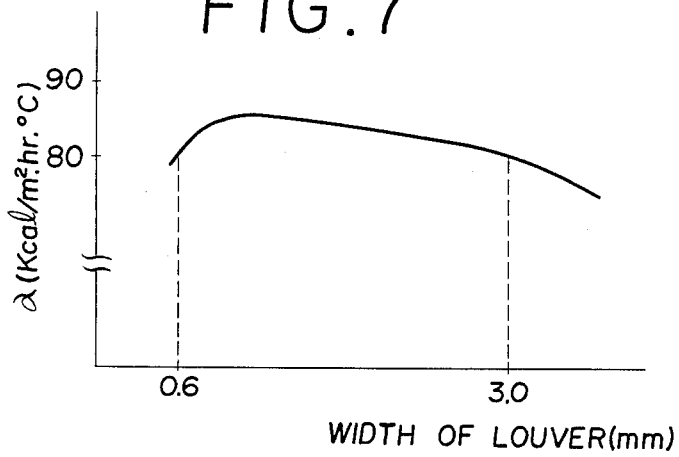
FIG. 7 is a graph showing the relation between the width of louvers and the heat-transfer coefficient.
Figure 8:
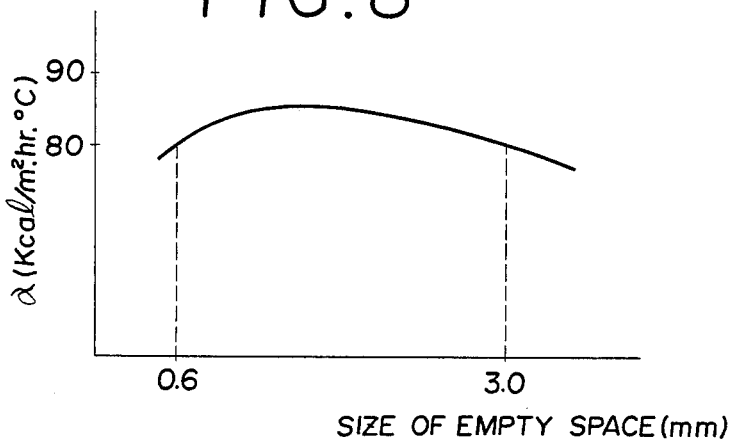
FIG. 8 is a graph showing the relation between the size of the empty space for discharge of water and the heat-transfer coefficient.
Figure 9:
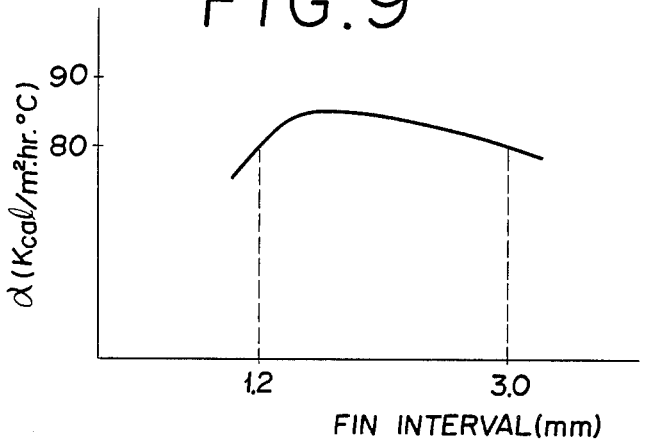
FIG. 9 is a graph showing the relation between the fin intervals and the heat-transfer coefficient.

Models of the heat exchangers 1, 11 illustrated in FIG. 1 and FIG. 2, each measuring about 200 mm in length A, about 220 mm in height B, and about 95 mm in width C, and each incorporating therein a corrugated fin the folds of which each measured 95 mm in length N and 16 mm in width M were tested at a wind velocity of 2.5 m/sec, with the width l of the louvers, the size of the empty space for water discharge, and the fin intervals L varied to determine how the coefficient of heat transfer $\alpha$ would be affected by these variables. The results were as shown in FIGS. 7–9 respectively. It is noted from FIG. 7 that the coefficient of heat transfer $\alpha$ increased as the width of the louvers increased, reached its peak when the width increased to the neighborhood of 1 mm, and started decreasing as the width increased further. The data testify that for the actual heat exchanger, the width l of the louvers is desired to fall in the range of 0.6 to 3.0 mm, preferably 1.0 to 2.0 mm.

FIG. 8 is a graph showing the relation between the size d of the empty space for water discharge and the coefficient of heat transfer $\alpha$. It is noted from the data that the coefficient of heat transfer $\alpha$ reached its peak when the size d was 1.2 mm, indicating that for the heat exchanger used as the evaporator, the size d is desired to fall in the range of 0.6 to 3.0 mm, preferably 0.8 to 1.5 mm. Similarly as shown in FIG. 9, the fin intervals L are desired to fall in the range of 1.2 to 3.0 mm, preferably 1.5 to 2.5 mm.

It has been demonstrated that the heat exchanger of the present invention used as the evaporator exhibits the highest coefficient of heat transfer and effects water discharge most advantageously when the values of l, d and L are selected to satisfy the aforementioned conditions. The water condensate adhering to the fin 15 or the louvers 21 gradually grows in size. When the size reaches a certain level, the current of air flowing along the front and rear sides of the louvers acts to scrape off the water condensate. Since a large water outlet 20 is formed in each of the folds of the fin 15, the water condensate thus scraped off the louvers has no alternative but to fall down the water outlet 20. The air flowing along the fin 15 wholly constitutes itself a main current and the water condensate is caused to fall off the rear sides of the louvers when the flow speed of air is high. It has been demonstrated by an experiment that the louvers are so effective in bringing about water discharge that the water condensate at times is caused to trickle along the louvers against the current of air and fall off the front sides of the louvers when the flow speed of air is low.

Figure 4:
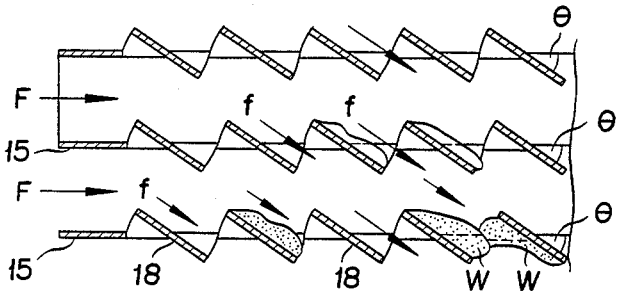
FIG. 4 PRIOR ART
FIG. 4 is a schematic cross sectional view taken along the line IV—IV in the diagram of FIG. 3.

A fin incorporating louvers of the conventional structure as shown in FIG. 4 and the fin of the present invention were tested for efficiency of water discharge under identical conditions. In the heat exchanger using the fin of the conventional sutucture, water condensate collected in large lumps along the rear end of the heat exchanger and such large lumps were at times scattered backwardly. In the heat exchanger using the fin of this invention, water condensate was not found to collect into lumps along the rear end of the heat exchanger but to reach the lower end of the heat exchanger without fail. The contrast was so sharp that in the latter heat exchanger, the attendant was often compelled to check the heat exchanger to confirm that the operating conditions such as the flow speed of air fed into the heat exchanger and the humidity of the air were the same as those used for the heat exchanger of the conventional structure.

Figure 10:
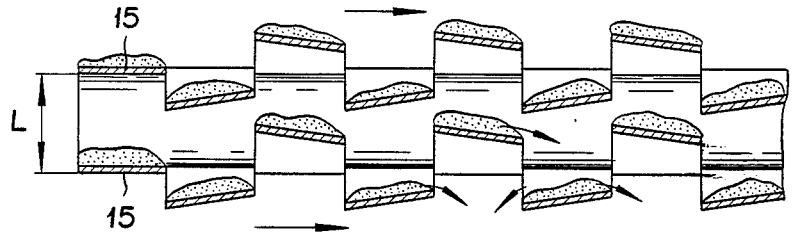
FIG. 10 is a schematic cross sectional view illustrating another embodiment of this invention.

FIG. 10 represents another embodiment of this invention. In this embodiment, the louver bodies are slanted by an angle of not more than 15 degrees, as by 10 degrees as illustrated. It has been ascertained experimentally that when the louvers are inclined as shown in FIG. 2, the efficiency of heat transfer and that of water discharge obtained in this embodiment are the same as those obtained in the preceding embodiment so long as the angle of this inclination is within the range that the air flowing along the louver bodies 12 induces no separation of boundary layer. When a heater core or radiator using engine coolant and serving as a condenser or heat exchanger is designed to effect exchange of heat by the structure contemplated by this invention, it enjoys high efficiency of heat transfer.

As described above, this invention provides a heat exchanger which comprises a tube for guiding heat-exchange fluid and a fin affixed to the outer side of the tube and adapted to guide air for exchanging heat with the aforementioned heat-exchange fluid, the fin having an opening formed in the web thereof and a multiplicity of louvers formed astraddle the opening substantially perpendicularly to the direction of the flow of the aforementioned air as staggered across the opening, the louvers each comprising a louver body separated by a fixed distance from the web of the fin and two legs connecting the opposite ends of the louver body to the web of the fin. The heat exchanger of this invention, when used as a condenser, a heater core, or a radiator, manifests the optimum efficiency of heat transfer and enables size reduction. When it is used as an evaporator, the speed of the current of air flowing along the fin can be utilized to the fullest extent as the force for the discharge of water condensate. Further the empty space for water discharge can be increased without entailing any decrease in the surface area of the fin or the louvers. Consequently, the efficiency of heat transfer can be maximized and the capacity for discharge of water condensate enhanced notably.

What is claimed is:

1. A heat exchanger comprising a tube for guiding heatexchange fluid and fin means comprising a web affixed to the outer side of said tube and adapted to guide air for exchanging heat with said heat-exchange fluid, said fin means having a longitudinal opening formed in said web and a multiplicity of transverse louvers formed astraddle said opening substantially perpendicularly to the direction of the flow of said air and staggered across said opening alternately above and below the plane of said web, said louvers each comprising a louver body separated a fixed distance from said web by two legs connecting the opposite ends of said louver body to said web and the fixed distance of any one louver being the same as that of any other louver, and wherein the width l of the louvers relative to the direction of air current is in the range of 0.6 to 3.0 mm, the size d of an empty space for water discharge formed between adjacent louvers is in the range of 0.6 to 3.0 mm, and the fin pitch L is in the range of 1.2 to 3.0 mm.

2. A heat exchanger according to claim 1, wherein said fin means comprises a plurality of parallel webs connected to form a corrugated fin but characterized in that the louvers of any one web which are above or below the plane of the web are opposed to the louvers of any adjacent web which are above or below respectively the plane of the web, whereby the distance between any two opposed louvers is the same as that of any other two opposed louvers and the same as the distance between the webs.

3. A heat exchanger according to claim 1, wherein said fin means comprises a plurality of parallel webs connected to form a corrugated fin but characterized in that the louvers of any one web which are above or below the plane of the web are opposed to the louvers of any adjacent web which are above or below respectively the plane of the web, whereby the distance between any two opposed louvers is the same as that of any other two opposed louvers and the same as the distance between the webs.

4. A heat exchange-type evaporator using coolant as heat-exchange fluid, which comprises tube means for guiding heat-exchange fluid comprising parallel tubes and fin means comprising a plurality of stacked, spaced-apart, substantially parallel webs which are substantially normal to said tubes, are affixed to said tubes in heattransfer relation, and are adapted to guide air for exchanging heat with said heat-exchange fluid; each said web having a multiplicity of upper and lower louvers formed therein by justaposed, like web portions aligned substantially perpendicularly to the direction of the flow of air and being displaced alternately above and below the plane of said web in such a manner that the upper louvers are horizontally and vertically aligned with upper louvers only, and lower louvers only, and wherein the width of the louvers relative to the l direction of air current is in the range of 0.6 to 3.0 mm, the size d of an empty space for water discharge formed between adjacent louvers is in the range of 0.5 to 3.0 mm, and the fin pitch L is in the range of 1.2 to 3.0 mm.

5. An evaporator according to claim 4, in which said louvers have flat, parallel upper surfaces.

6. An evaporator according to claim 5, in which said flat, parallel surfaces are parallel to the plane of the web.

* * * * *

UNITED STATES PATENT AND TRADEMARK OFFICE

CERTIFICATE OF CORRECTION

PATENT NO. : 4,615,384

DATED : October 7, 1986

INVENTOR(S) : Yukio Shimada and Noriaki Sonoda

It is certified that error appears in the above-identified patent and that said Letters Patent is hereby corrected as shown below:

Col. 2, lines 11 & 12; "enhacing" should read -- enhancing --

Col. 2, line 31; "degree" should read -- degrees --

Col. 6, line 6; "heatexchange" should read -- heat-exchange --

Col. 6, line 57; after "lower louvers" insert -- are horizontally and vertically aligned with lower louvers --

Signed and Sealed this

Twenty-first Day of April, 1987

*Attest:*

*Attesting Officer*

DONALD J. QUIGG

*Commissioner of Patents and Trademarks*